US008185015B2

(12) United States Patent
Okabe

(10) Patent No.: US 8,185,015 B2
(45) Date of Patent: May 22, 2012

(54) IMAGE FORMING APPARATUS AND PROCESS CARTRIDGE

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 279 days.

(21) Appl. No.: 12/549,428

(22) Filed: Aug. 28, 2009

(65) Prior Publication Data

US 2010/0054800 A1 Mar. 4, 2010

(30) Foreign Application Priority Data

Aug. 28, 2008 (JP) ..... 2008-220078

(51) Int. Cl.
*G03G 21/18* (2006.01)

(52) U.S. Cl. ..... 399/114; 399/110; 399/111; 399/262

(58) Field of Classification Search ..... 399/110, 399/111, 114, 262
See application file for complete search history.

(56) References Cited

U.S. PATENT DOCUMENTS 6,032,002 A * 2/2000 Yokomori et al. ..... 399/12
6,038,417 A * 3/2000 Nagamine et al. ..... 399/125
6,690,902 B2 * 2/2004 Noda et al. ..... 399/111
7,149,457 B2 * 12/2006 Miyabe et al. ..... 399/114
2003/0156856 A1 * 8/2003 Arimitsu et al. ..... 399/114
2005/0244188 A1 * 11/2005 Sato et al. ..... 399/114
2007/0003320 A1 * 1/2007 Park ..... 399/114
2007/0154233 A1 * 7/2007 Ukai ..... 399/90
2008/0159781 A1 7/2008 Noguchi et al.

FOREIGN PATENT DOCUMENTS

JP 10-123912 A 5/1998
JP 2001-282076 A 10/2001
JP 2001-337580 A 12/2001
JP 2008-165027 7/2008

OTHER PUBLICATIONS

Notification of Reason for Refusal dated Oct. 26, 2010 in Japanese Patent Application No. 2008-220078 and English translation thereof.
JP Office Action dtd Jun. 22, 2010, JP Appln. 2008-220078, partial English translation.

* cited by examiner

*Primary Examiner* — David Gray
*Assistant Examiner* — Francis Gray
(74) *Attorney, Agent, or Firm* — Banner & Witcoff, Ltd.

(57) ABSTRACT

An image forming apparatus includes: a main body; a process frame that is removably installed into the main body; and a process cartridge that is detachably installed in the process frame; the process cartridge including: a photosensitive member; and a shutter member that is configured to be movable between a closed position where the photosensitive member is covered and an open position where the photosensitive member is exposed, wherein the shutter member moves from the closed position to the open position as the process frame is operated to be installed into the main body.

27 Claims, 9 Drawing Sheets

IMAGE FORMING APPARATUS AND PROCESS CARTRIDGE

CROSS REFERENCE TO RELATED APPLICATION

The present application claims priority from Japanese Patent Application No. 2008-220078, which was filed on Aug. 28, 2008, the disclosure of which is herein incorporated by reference in its entirety.

TECHNICAL FIELD

The present invention relates to an image forming apparatus such as a color laser printer and a process cartridge that is to be installed in the image forming apparatus.

BACKGROUND

As electrophotographic color laser printers, there have been known tandem color laser printers which include four photosensitive drums which correspond to toner of four colors such as yellow, magenta, cyan and black.

Then, as a tandem color laser printer like this, there has been proposed, for example, an electrophotographic color image forming apparatus in which a plurality of process cartridges each including an electrophotographic photosensitive drum are drawn out or pushed into an apparatus main body in such a state that the process cartridges are supported on a movable member.

SUMMARY

However, in a configuration described above, since the process cartridges do not have members for protecting the electrophotographic photosensitive drums, when the process cartridges are drawn out of the apparatus main body, the electrophotographic photosensitive drums are exposed at all times.

Because of this, when the process cartridges are left drawn out of the apparatus main body, there is caused a fear that the exposed electrophotographic photosensitive drums are brought into contact with objects lying on the peripheries thereof to thereby be damaged.

On the other hand, according to another related art, shutters are provided on the process cartridges such that the shutters are configured to be opened when the process cartridges are installed in the movable member. When the movable member in which the process cartridges are installed is pushed into the electrophotographic color image forming apparatus, there is also caused a fear that the exposed electrophotographic photosensitive drums are brought into contact with objects lying on the peripheries thereof to thereby be damaged.

Accordingly, an object of the invention is to provide an image forming apparatus in which photosensitive members can be protected until process cartridges are installed in the image forming apparatus and a process cartridge which is installed in the image forming apparatus.

According to an illustrative aspect of the present invention, there is provided an image forming apparatus comprising: a main body; a process frame that is removably installed into the main body; and a process cartridge that is detachably installed in the process frame; the process cartridge including: a photosensitive member; and a shutter member that is configured to be movable between a closed position where the photosensitive member is covered and an open position where the photosensitive member is exposed, wherein the shutter member moves from the closed position to the open position as the process frame is operated to be installed into the main body.

BRIEF DESCRIPTION OF THE DRAWINGS

Illustrative aspects of the invention will be described in detail with reference to the following figures wherein:

FIG. 2A shows a state in which a shutter is disposed in a closed position, FIG. 2B shows a state in which the shutter is disposed in a half-open position, and FIG. 2C shows a state in which the shutter is disposed in a closed position;

DETAILED DESCRIPTION OF EXEMPLARY EMBODIMENTS OF THE PRESENT INVENTION

1. Overall Configuration of Color Laser Printer

Figure 1:
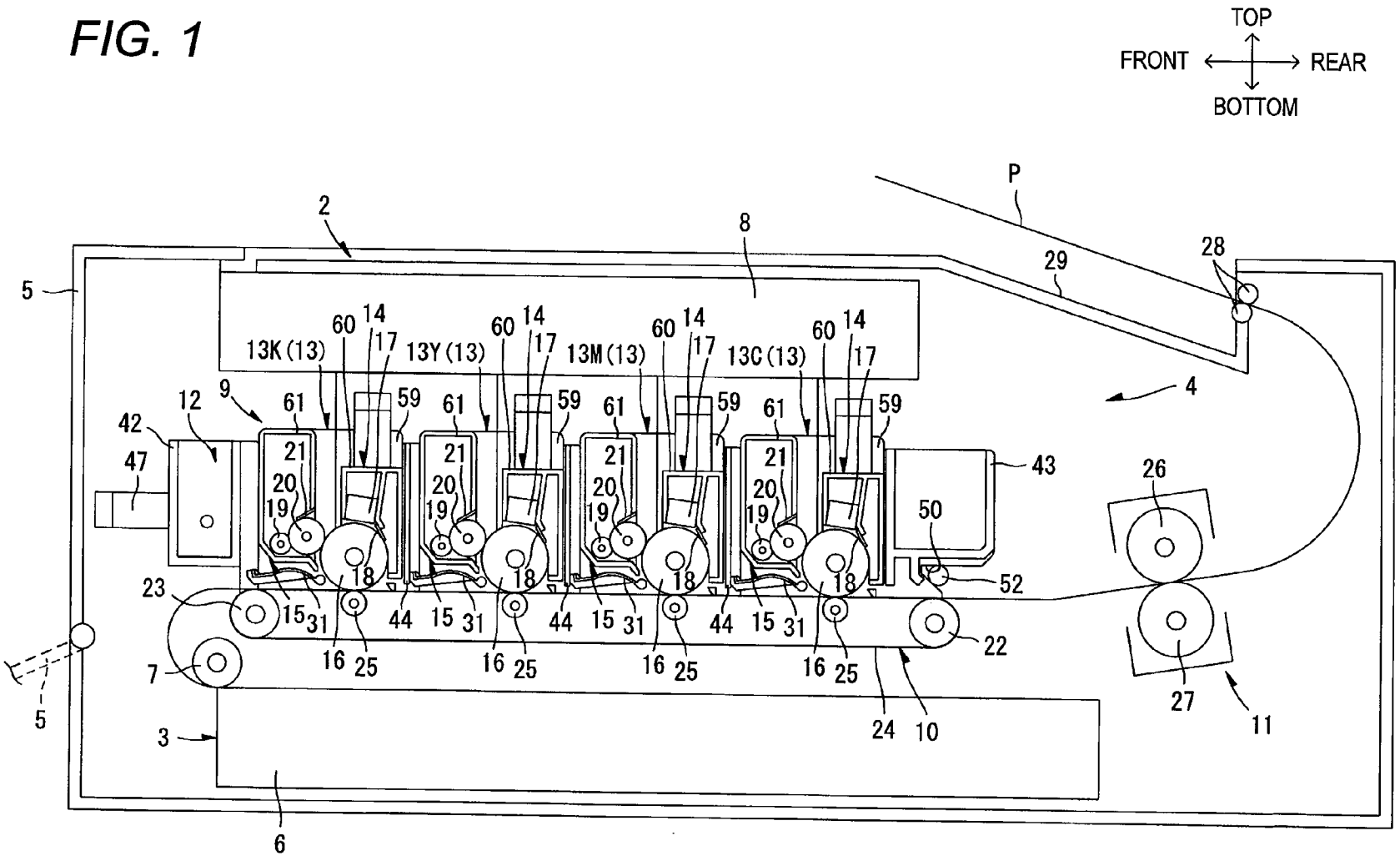
FIG. 1 is a side sectional view showing an embodiment of a color laser printer as an example of an image forming apparatus of the invention.

FIG. 1 is a side sectional view showing an embodiment of a color laser printer as an example of an image forming apparatus of the invention.

This color laser printer 1 is a horizontal tandem color laser printer and includes a feeder unit 3 for feeding sheets P and an image forming unit 4 for forming an image on a sheet P fed within a body casing 2 as an example of a main body.

(1) Body Casing

The body casing 2 is formed into a box shape which is rectangular when viewed from a side thereof, and the image forming unit 4 is accommodated in the body casing 2 so formed. In addition, a front cover 5 is provided in one of side walls of the body casing 2 for installation of a process frame 12, which will be described later, thereinto.

In addition, in the following description, a side (a left-hand side in FIG. 1) of the body casing 2 where the front cover 5 is provided is referred to as a front side, and an opposite side thereto (a right-hand side in FIG. 1) is referred to as a rear side. In addition, it should be understood that when talking about the left and right of the color laser printer 1, the color laser printer 1 is basically seen from the front side thereof. Namely, a near side of a sheet of paper on which FIG. 1 is drawn is referred to as the right-hand side, and a far side of the sheet of paper is referred to as the left-hand side.

(2) Feeder Unit

The feeder unit 3 includes a sheet feeding tray 6 which houses sheets P. The sheet feeding tray 6 is detachably installed at a bottom portion in the body casing 2. A feed roller 7 and a sheet feeding path configured by a U-turn path are disposed above a front end portion of the sheet feeding tray 6.

Sheets P housed in the sheet feeding tray 6 are fed sheet by sheet towards the sheet feeding path by rotation of the feed roller 7. Thereafter, sheets P are transported from the sheet feeding path towards the image forming unit 4 (between photosensitive drums 16 (which will be described later) and a transport belt 24 (which will be described later)).

(3) Image Forming Unit

The image forming unit 4 includes a scanner unit 8, a process unit 9, a transfer unit 10 and a fixing unit 11.

(3-1) Scanner Unit

The scanner unit 8 is disposed in an upper portion in the body casing 2. As is indicated by chain lines, the scanner unit 8 emits individually laser beams based on image data towards four photosensitive drums 16 (which will be described later), so as to expose the photosensitive drums 16 (which will be described later).

(3-2) Process Unit

The process unit 9 is disposed below the scanner unit 8 and above the feeder unit 3 and includes one process frame 12 and four process cartridges 13 which correspond individually to four colors.

The process frame 12 is installed in the body casing 2 so as to be inserted into or drawn out of the body casing 2 along a front-rear direction.

The process cartridges 13 are detachably installed in the process frame 12 so as to be disposed parallel to each other along the front-rear direction. Specifically, a black process cartridge 13K, a yellow process cartridge 13Y, a magenta process cartridge 13M and a cyan process cartridge 13C are disposed sequentially in that order from the front side towards the rear side.

(3-2-1) Process Cartridge

Each process cartridge 13 includes a pair of left and right unit side walls 59, a drum unit 14 as an example of a photosensitive member unit which is supported between both the unit side walls 59 and a developing unit 15.

Both the unit side walls 59 are each formed into a rectangular shape when viewed from a side thereof and are disposed to face each other while being spaced apart from each other in a left-right direction (refer to FIG. 2).

The drum unit 14 is defined by a drum partition wall 60 which is located between both the unit side walls 59 and at rear sides thereof and is made to be opened at a bottom thereof and includes a photosensitive drum 16 as an example of a photosensitive member, a scorotron-type charger 17 and a cleaning film 18.

The photosensitive drum 16 is disposed along the left-right direction and is supported rotatably between both the unit side walls 59 so as to be exposed downwards.

The scorotron-type charger 17 is disposed obliquely rearwards and upwards of the photosensitive drum 16 so as to face the photosensitive drum 16 while being spaced apart therefrom and is supported on the drum partition wall 16.

The cleaning film 18 is disposed at the rear of the photosensitive drum 16 so as to face the photosensitive drum 16 while being in contact therewith and is supported on the drum partition wall 60.

The developing unit 15 is defined by a developing partition wall 61 which is located between both the unit side walls 59 and at front sides thereof and is opened at a rear side thereof which faces the photosensitive drum 16 and includes a supply roller 19, a developing roller 20 as an example of a developer carrier and a layer thickness control blade 21.

The developing roller 20 is exposed from the developing partition wall 61 and is disposed so as to be brought into contact with the photosensitive drum 16. The supply roller is disposed in front of the developing roller 20, and the layer thickness control blade 21 is disposed above the developing roller 20. In addition, toner corresponding to one of the four colors is accommodated within a space lying above the supply roller 19, the developing roller 20 and the layer thickness control blade 21 within the developing partition wall 61.

(3-2-2) Developing Operation in Process Cartridge

Toner accommodated within the developing unit 15 is supplied to the supply roller 19 and is then supplied to the developing roller 20, and the toner so supplied is friction charged positively between the supply roller 19 and the developing roller 20.

Toner supplied to the developing roller 20 is controlled with respect to its thickness by the layer thickness control blade 21 as the developing roller rotates and is then carried on a surface of the developing roller 20 as a thin layer having a constant thickness.

On the other hand, a surface of the photosensitive drum 16 is charged uniformly positively by the scorotron-type charger 17 as the photosensitive drum 16 rotates and is then exposed by a laser beam (refer to broken lines in FIG. 1) which is emitted from the scanner unit 8 and passes between the drum partition wall 60 and the developing partition wall 61 through high-speed scanning. An electrostatic latent image which corresponds to an image that is to be formed on a sheet P is formed on the surface of the photosensitive drum 16 by the exposure.

When the photosensitive drum 16 rotates further, the toner which is carried on the surface of the developing roller 20 and is positively charged is supplied to the electrostatic latent image formed on the surface of the photosensitive drum 16. By the toner being so supplied, the electrostatic latent image on the photosensitive drum 16 is visualized, and a toner image developed by reversing development is carried on the surface of the photosensitive drum 16.

(3-3) Transfer Unit

The transfer unit 10 is disposed to extend along the front-rear direction above the feeder unit 3 and below the process unit 9 within the body casing 2. This transfer unit 10 includes a drive roller 22, a driven roller 23, and a transport belt 24 as an example of an endless belt and transfer rollers 25.

The drive roller 22 and the driven roller 23 are disposed spaced apart in the front-rear direction so as to face each other, and the transport belt 24 is wound round these rollers.

The transfer rollers 25 are provided so as to face the corresponding photosensitive drums 16 with the transport belt 24 held therebetween.

In addition, a sheet P which is fed from the feeder unit 3 is transported from the front side towards the rear side by the transport belt 24 in such a manner as to pass through transfer positions where the photosensitive drum 16 confronts the corresponding transfer roller 25 sequentially. During the transport, the toner images in the individual colors which are carried on the respective photosensitive drums 16 are transferred onto the sheet P sequentially, so as to form a color image on the sheet P.

(3-4) Fixing Unit

The fixing unit 11 is disposed at the rear of the transport unit 10 and includes a heating roller 26 and a pressing roller 27 which confronts the heating roller 26. The color image which has been transferred onto the sheet P in the transfer unit 10 is heated and pressed during passage between the heating roller 26 and the pressing roller 27 to thereby be thermally fixed on the sheet P.

(4) Sheet Discharge

The sheet P on which the toner image is now fixed passes through a sheet discharging path which is configured by a U-turn path and is then transported towards a discharge roller 28. Thereafter, the sheet P is discharged by the discharge roller 18 on to a sheet discharging tray 29 which is formed on an upper surface of the body casing 22.

2. Details of Process Unit

Figures 2A, 2B, 2C:
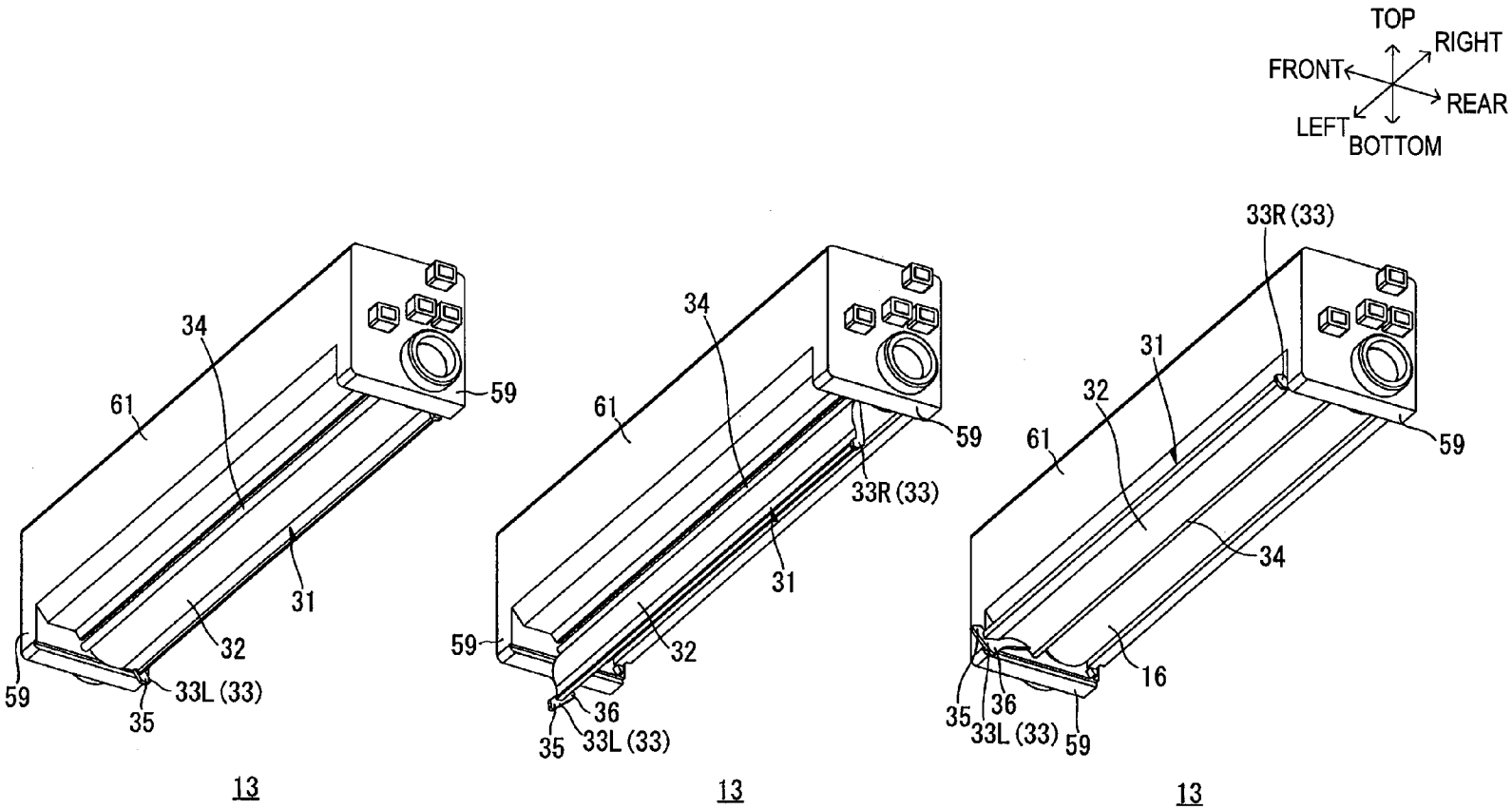
FIGS. 2A to 2C are perspective views of a process cartridge shown in FIG. 1 when viewed from therebelow.

FIGS. 2A to 2C show perspective views of the process cartridge when viewed from therebelow, FIG. 2A shows a state in which a shutter is disposed in a closed position, FIG. 2B shows a state in which the shutter is disposed in a half-open position, and FIG. 2C shows a state in which the shutter is disposed in a closed position.

Figure 3:
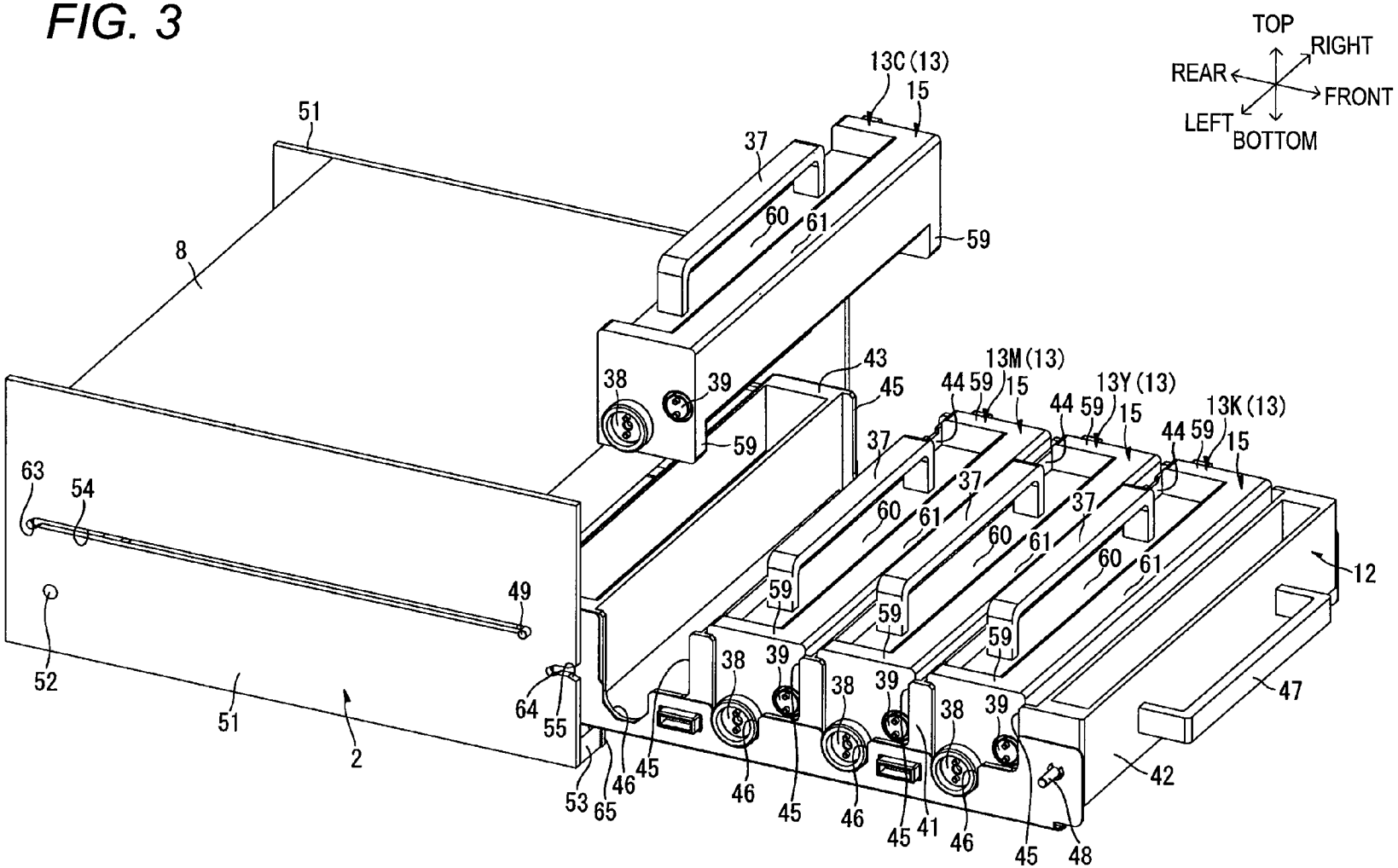
FIG. 3 is a perspective view showing a state in which a process frame shown in FIG. 1 is drawn out of a body casing for installation and removal of process cartridges into and from the process frame.

FIG. 3 is a perspective view showing a state in which the process frame shown in FIG. 1 is drawn out of the body casing for installation and removal of the process cartridges into and from the process frame.

(1) Details of Process Cartridge

As shown in FIGS. 2A to 2C, in the process cartridge 13, as has been described above, the drum partition wall 60 is provided to extend between both the unit side walls 50 at the rear sides thereof, and the developing partition wall 61 is provided to between both the unit side walls 59 at the front sides thereof. Both the unit side walls 59 are formed longer in a downward direction than a rear wall of the drum partition wall 60 and a front wall of the developing partition wall 61. By this configuration, the process cartridge 13 is formed into substantially an inverted U-like shape when viewed from the front thereof. In addition, a shutter 31 as an example of a shutter member is provided to extend between lower end portions of both the unit side walls 59.

The shutter 31 is formed of a hart resin and includes integrally a covering portion 32, a pair of left and right shutter side plates 33 and a shaft portion 34 as an example of a swing shaft. In addition, as will also be described later, the shutter 31 is provided to move between a closed position (refer to FIG. 2A) where to cover the photosensitive drum 16 and an open position (refer to FIG. 2C) which confronts the developing unit 15 in a position lying further forwards than the closed position and where to expose the photosensitive drum 16.

The covering portion 32 has a plate-like shape which extends along the left-right direction and has a curved cross-sectional configuration so as to match an outer circumferential surface of the photosensitive drum 16.

As shown in FIG. 2C, the shutter side plates 33 extend continuously from both left and right end portions of the covering portion 32 in downward and upward directions so as to be formed into substantially V-shaped plate-like elements.

In addition, a sliding and grazing portion 36 and an engagement portion 35 are provided at an end portion of the left-hand shutter side plate 33 which is opposite to an end portion where the shaft portion 34 is provided.

The sliding and grazing portion 36 is formed into a rounded triangular shape when viewed from a side thereof which swells downwards when the shutter 31 is disposed in the open position.

As shown in FIG. 2A, the engagement portion 35 is formed into a wedge-like shape when viewed from a side thereof which projects rearwards as it extends downwards when the shutter 31 is disposed in the closed position.

The shaft portion 34 is formed into a rod-like shape which extends along the left-right direction so as to be continuous with a front end portion of the covering portion 32 when the shutter 31 is disposed in the closed position. In addition, the shaft portion 34 is disposed to extend between substantially central positions in the front-rear direction at lower end portions of both the unit side walls 59, that is, the shaft portion 34 is disposed between the drum unit 14 and the developing unit 15, and both end portions in the left-right direction of the shaft portion 34 are supported on both the unit side walls 59 so as to rotate relative thereto.

In addition, a coil spring, which is connected to the unit side wall 59 at one end and is locked on the covering portion 32 at the other end, is wound round the shaft portion 34.

The shutter 31 is disposed in the closed position at all times by virtue of a biasing force of the coil spring.

In addition, the shutter 31 can swing freely about an axis of the shaft portion 34 as a fulcrum so as to move against the biasing force of the coil spring from the closed position (refer to FIG. 2A) to the open position (refer to FIG. 2C) via a half-open position (refer to FIG. 2B). On the contrary, the shutter 31 moves from the open position (refer to FIG. 2C) to the closed position (refer to FIG. 2A) via the half-open position (refer to FIG. 2B) by virtue of the biasing force of the coil spring.

As shown in FIG. 2A, when in the closed position, the shutter 31 covers completely the photosensitive drum 16 from therebelow. In addition, as shown in FIG. 2B, when in the half-open position, the shutter 31 is suspended vertically downwards. Note that the half-open position is a middle position which lies just midway between the closed position and the open position.

In addition, as is shown in FIG. 2C, when in the closed position, the shutter 31 exposes completely the photosensitive drum 16 from therebelow and is disposed in 10 such a manner as to confront a lower wall of the developing partition wall 61 from therebelow.

In addition, as is shown in FIG. 3, a unit grip portion 37 is provided on an upper wall of the drum partition wall 60 so that the user can grip thereon when he or she installs or removes the process cartridge 13 into or from the process frame 12.

Additionally, a drum coupling portion 38 via which a driving force is inputted from the body casing 2 into the photosensitive drum 16 and a developing coupling portion 39 via which a driving force is inputted from the body casing 2 into the developing unit 15 are provided on the left-hand unit side wall 59 of the process cartridge 13.

(2) Details of Process Frame

As is shown in FIG. 3, the process frame 12 is formed of a hard resin into a frame-like shape for accommodation of four process cartridges 13 and includes integrally a pair of left and right frame side walls 41, a front beam 42, a rear beam 43 and a plurality of positioning plates 44.

The frame side walls 41 are disposed to face each other with the four process cartridges 13 held therebetween in the left-right direction. In addition, in each frame side wall 41, four cut-out portions 45 and four positioning grooves 46 are formed. Specifically, the four cut-out portions 45 are formed by cutting downwards the frame side wall 41 from an upper end thereof at portions which face individually the process cartridges 13, and the four positioning grooves 46 are formed by cutting further downwards the frame side wall 41 from lower ends of the cut-out portions 45.

The cut-out portion 45 is sized to expose both the drum coupling portion 38 and the developing coupling portion 39 and is formed into a rectangular shape when viewed from a side thereof.

The positioning groove 46 is formed into a substantially U-shape when viewed from a side thereof which is made to open upwards so as to be brought into abutment with an outer circumferential surface of the drum coupling portion 38.

Figure 5:
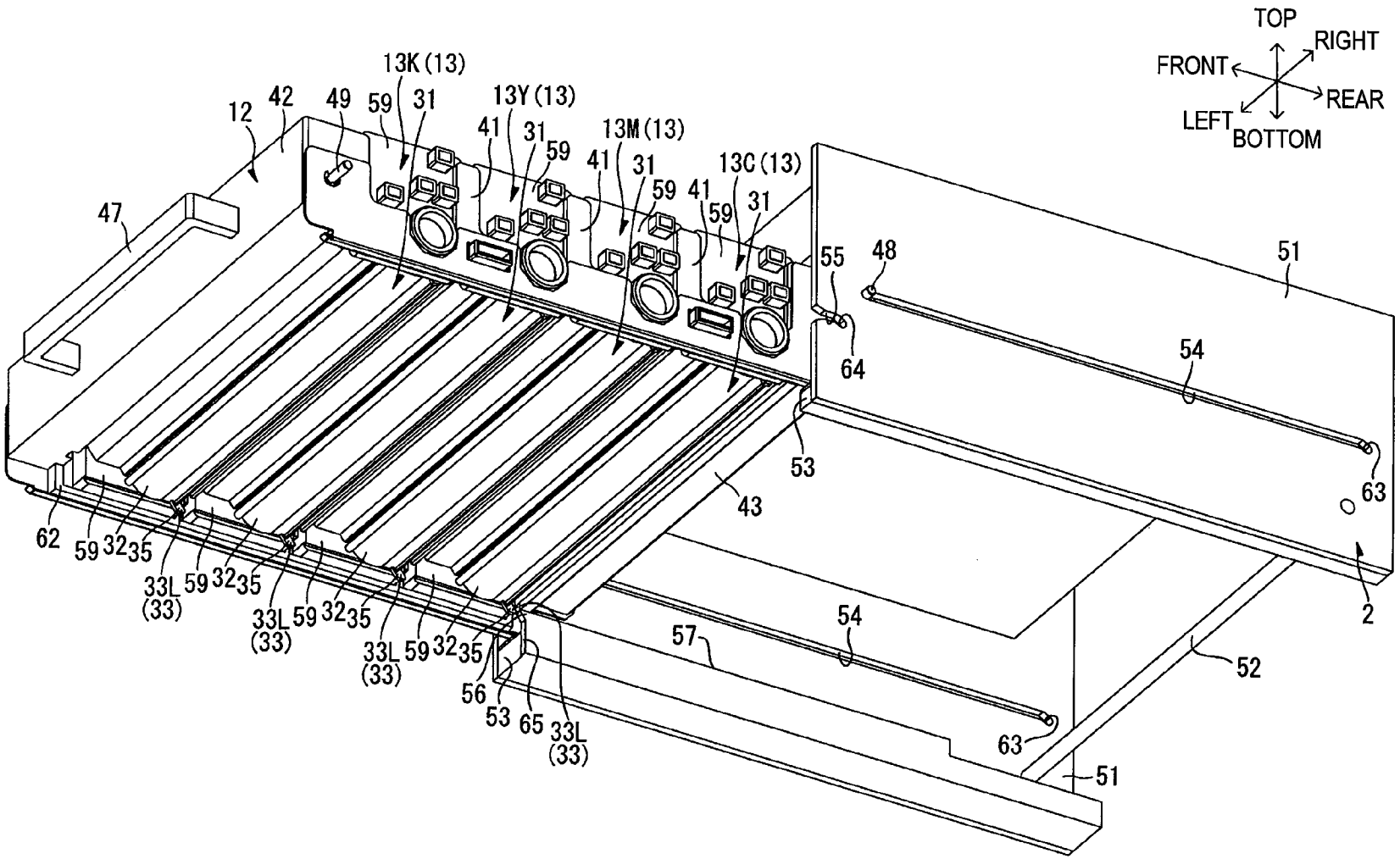
FIG. 5 is an explanatory diagram which explains the operation of installing the process frame in which the process cartridges are installed into the body casing and shows a state in which the process frame is drawn out of the body casing.

In addition, an elongated projection 62 is provided at a lower end portion on an inner surface of each frame side wall 41 which faces an inner surface of the other side wall 41 in such a manner as to extend along the front-rear direction so that the lower end portion of the corresponding unit side wall 59 of the process cartridge 13 is locked thereon (refer to FIG. 5).

The front beam 42 has a substantially U-shaped cross section and is provided so as to extend between front end portions of the respective frame side walls 41. A frame grip portion 47 is formed integrally on a front surface of the front beam 42 so that the user can grip thereon when he or she installs or removes the process frame 12 into or from the body casing 2.

The rear beam 43 has a substantially U-shaped cross section and is provided so as to extend between rear end portions of the respective frame side walls 41. In addition, a reference groove 50 is formed at a lower portion of the rear beam 43 so as to be made to open towards the rear so the a reference shaft 52 (which will be described later) on the body casing 2 is fitted thereinto when the process frame is completely installed into the body casing 2 (refer to FIG. 1).

Three positioning plates 44 are provided to extend between both the frame side walls 41 so as to be disposed at equal intervals between the front beam 42 and the rear beam 43. In addition, the positioning plate 44 extends in a top-bottom direction as well as in the left-right direction, and both end portions in the left-right direction of the positioning plate 44 are connected to the corresponding frame side walls 41 between the adjacent cut-out portions 45.

By the positioning plates 44 being configured in the way described above, a space surrounded by the front beam 42, the rear beam 43 and the pair of left and right frame side walls 41 is divided equally into four sections in the front-rear direction by the three positioning plates 44.

In addition, a first guide shaft 48 and a second guide shaft 49 are provided at a rear end portion and a front end portion of the process frame 12, respectively, so as to extend throughout the process frame 12 in the left-right direction, and both end portions of the first guide shaft 48 and both end portions of the second guide shaft 49 are made to project outwards from both the frame side walls 41 in the left-right direction.

3. Details of Body Casing

Figure 4:
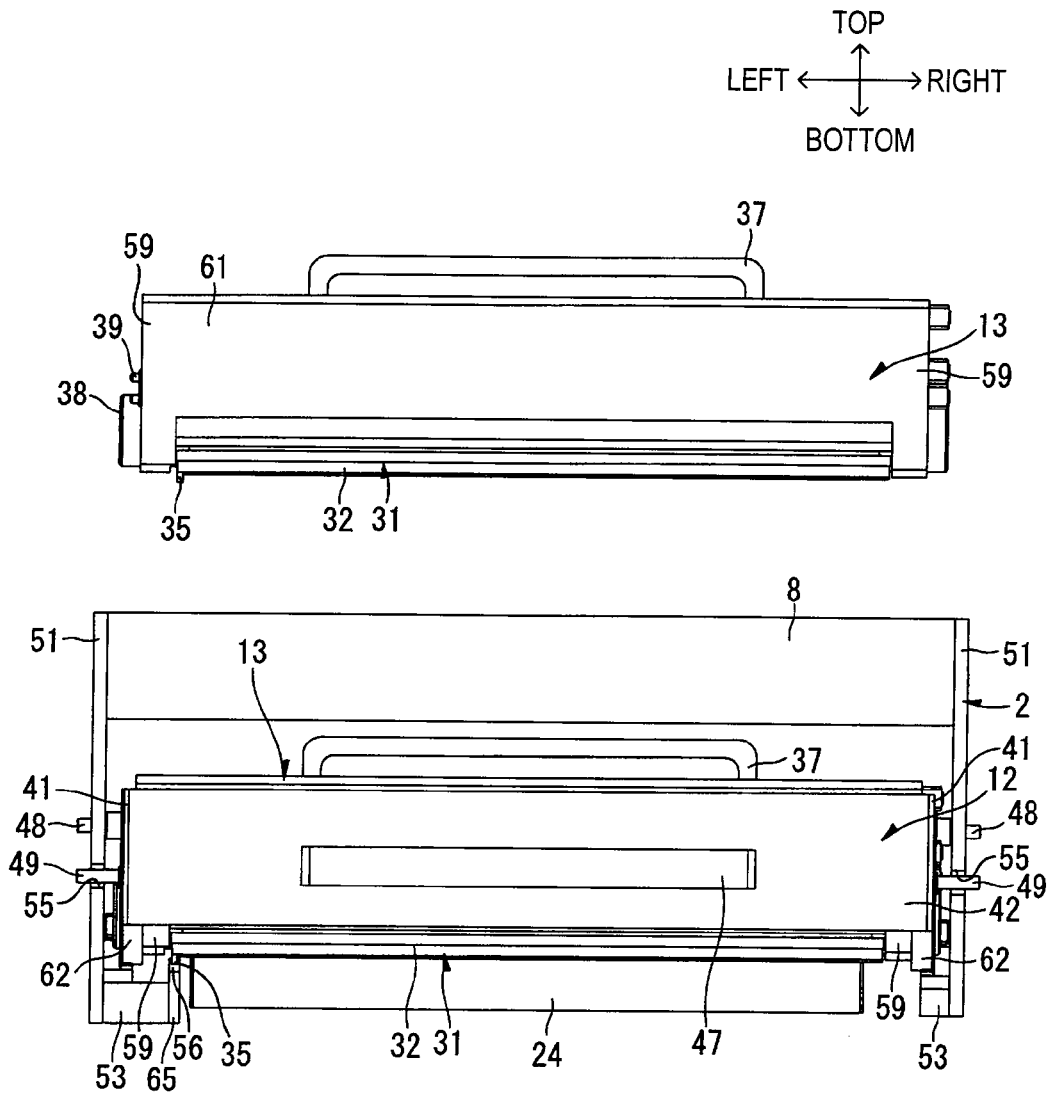
FIG. 4 is a front view which corresponds to FIG. 3.

FIG. 4 is a front view which corresponds to FIG. 3.

FIG. 5 is an explanatory diagram which explains the operation of installing 5 the process frame in which the process cartridges are installed into the body casing and shows a state in which the process frame is drawn out of the body casing.

As shown in FIGS. 4 and 5, the body casing 2 includes a pair of left and right casing side walls 51 and the reference shaft 52 which is provided to extend between both the casing side walls 51.

Each casing side wall 51 includes a frame support portion 53. In addition, a first guide groove 54 and a second guide groove 55 are formed in each casing side wall 51.

The frame support portion 53 is provided to extend along the front-rear direction at a lower end portion on an inner surface side of each casing side wall 51 which faces an inner surface side of the other casing side wall 51 in such a manner as to swell towards the inner surface side of the other casing side wall 51 which it faces.

In addition, upper edges of the frame support portions 53 are brought into abutment with lower edges of both the end portions in the left-right direction of the process frame 12 when the process frame 12 is completely installed into the body casing 2, so as to support the process frame 12 from therebelow.

The first guide groove 54 is formed so as to extend along the front-rear direction in a substantially central position in the top-bottom direction of the casing side wall 51.

In addition, the first guide shaft 48 of the process frame 12 is slidably inserted into the first guide grooves 54.

Additionally, a bent portion 63 is formed at a rear end portion of each of the first guide grooves 54 in such a manner as to guide the first guide shaft 48 to be inclined downwards as it moves really towards the rear.

The second guide groove 55 is formed in each of the casing side walls 51 in a slightly lower position than the first guide groove 54 so as to be cut out rearwards from a front end portion of the casing side wall 51.

In addition, the second guide grooves 54 receive therein the second guide shaft 49 of the process frame 12 when the process frame 12 is completely installed into the body casing 2.

Additionally, as at the rear end portion of the first guide groove, a bent portion 64 is formed at a rear end portion of each of the second guide grooves 55 so as to guide the second guide shaft 49 to be inclined downwards as it moves towards the rear.

The reference shaft 52 is formed of a metal into a rod-like shape and is provided to extend between lower positions at rear end portions of the pair of casing side walls 51. The reference groove 50 on the process frame 12 is fitted on the reference shaft 52 when the process frame 12 is completely installed into the body casing 2.

In addition, a shutter opening plate 65 which includes integrally an abutment portion 56 and a restricting portion 57 is provided on the frame support portion 53 on the left-hand casing side wall 51 in a position lying on a left-hand side of the transport belt 24 and closer to the transport belt 24 than an upper end surface of the transport belt 24.

The shutter opening plate 65 is formed into a substantially rectangular shape which extends along the front-rear direction and is provided along a right-hand side surface of the frame support portion 53 on the left-hand casing side wall 51. In addition, the shutter opening plate 65 is provided to extend from a front edge to a position lying slightly further rearwards than a center in the front-rear direction of the casing side wall 51.

The abutment portion 56 is formed into a wedge-like shape when viewed from a side thereof so as to project forwards from an upper portion at a front edge of the shutter opening plate 65.

The restricting portion 57 is connected to the abutment portion 56 and is provided as an upper edge of the shutter opening plate 65, being formed into a flat shape in the front-rear direction.

4. Installing Operations of Process Cartridges and Process Frame

Figure 6:
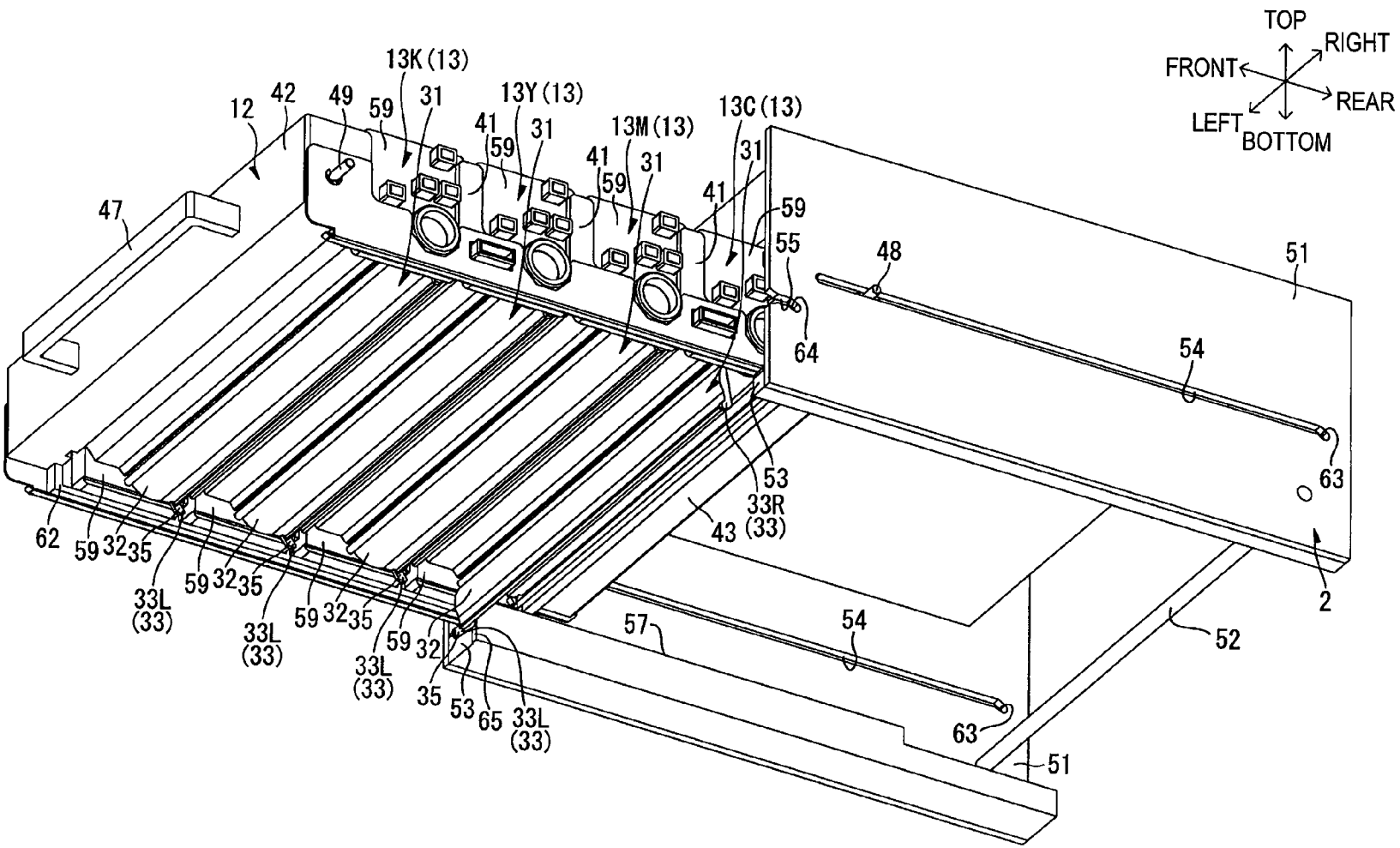
FIG. 6 is an explanatory diagram which explains the operation of installing the process frame in which the process cartridges are installed into the body casing and shows a state in which and shows a state in which a shutter of a cyan process cartridge has moved to the half-open position.
Figure 7:
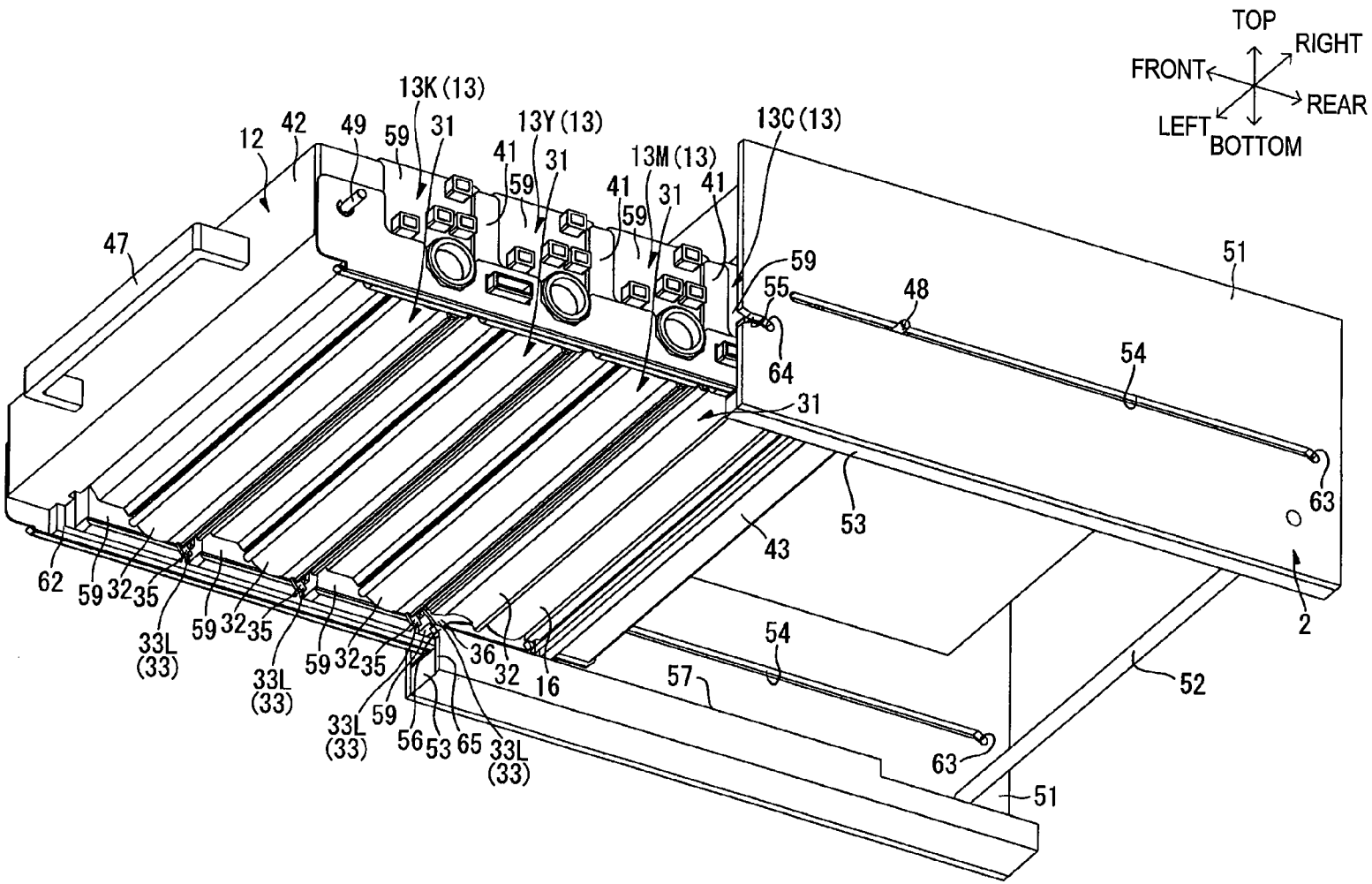
FIG. 7 is an explanatory diagram which explains the operation of installing the process frame in which the process cartridges are installed into the body casing and shows a state in which and shows a state in which the shutter of the cyan process cartridges has moved to an intermediate position.
Figure 8:
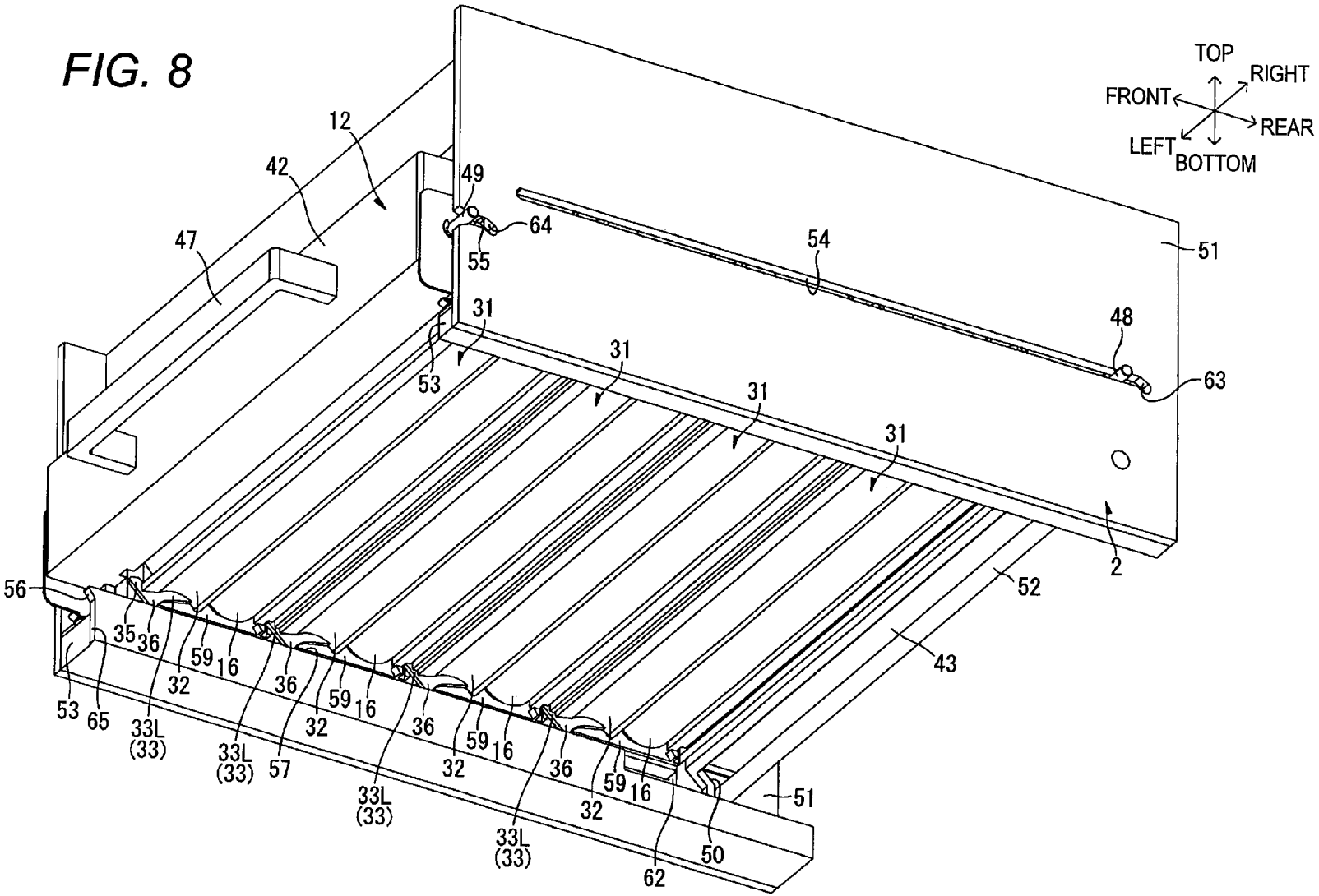
FIG. 8 is an explanatory diagram which explains the operation of installing the process frame in which the process cartridges are installed into the body casing and shows a state in which and shows a state in which the shutters of all the process cartridges have moved to the intermediate positions.
Figure 9:
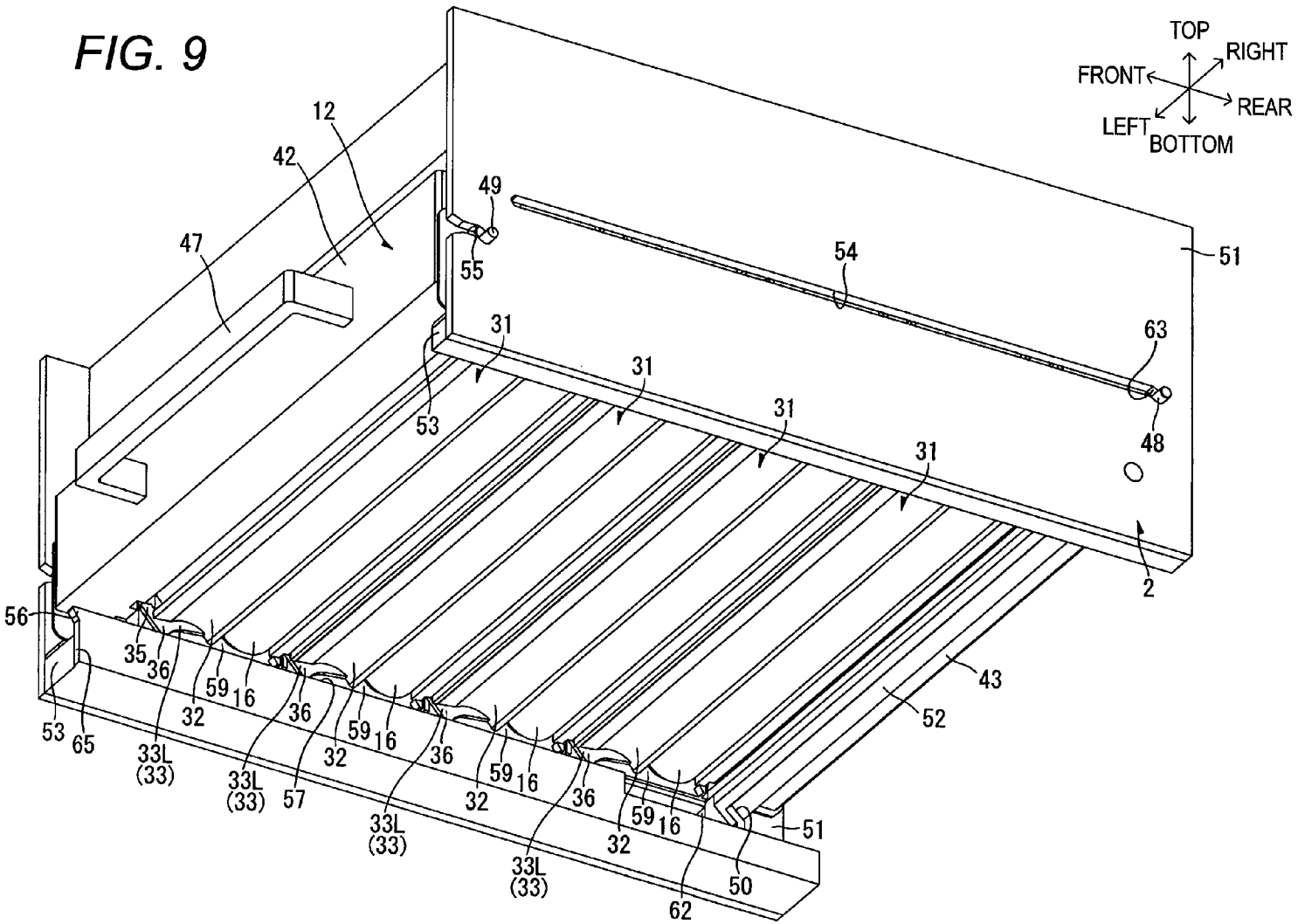
FIG. 9 is an explanatory diagram which explains the operation of installing the process frame in which the process cartridges are installed into the body casing and shows a state in which and shows a state in which the installation of the process frame has been completed.

FIGS. 6 to 9 are explanatory diagrams which explain the operation of installing the process frame in which the process cartridges are installed into the body casing, of which FIG. 6 shows a state in which the shutter of the cyan process cartridge has moved to the half-open position, FIG. 7 shows a state in which the shutter of the cyan process cartridges has moved to an intermediate position, FIG. 8 shows a state in which the shutters of all the process cartridges have moved to intermediate positions, and FIG. 9 shows a state in which the installation of the process frame has been completed.

(1) Installation of Process Cartridges into Process Frame

In installing the process cartridges 13 into the process frame 12, firstly, the process frame 12 is firstly drawn out of the body casing 2.

When the process frame 12 is drawn out of the body casing 2, as shown in FIG. 5, the first guide shaft 48 of the process frame 12 is disposed at frontmost end portions of the first guide grooves 54 in the body casing 2. In addition, the engagement portion 35 of the shutter 31 of the cyan process cartridge 13C is made to face the abutment portion 56 of the body casing 2 in the front-rear direction.

Then, by gripping on the unit grip portion 37 of the process cartridge 13, the process cartridge 13 is aligned with the process frame 12 such that a front end portion and a rear end portion of the process cartridge 13 match the positioning plate 44 and the drum coupling portion 38 fits in the positioning groove 46 and is then inserted into the process frame 12.

Then, the lower end portions of both the unit side walls 59 of the process cartridge 13 are locked on the elongated projections 62 on both the frame side walls 41, whereby the process cartridge 13 is installed into the process frame 12.

The shutter 31 is in the closed position in the stage in which the process cartridge 13 is installed into the process frame 12, and hence, the photosensitive drum 16 is covered by the shutter 31.

(2) Installation of Process Frame into Body Casing

In addition, in installing the process frame 12 into the body casing 2, by gripping on the frame grip portion 47, the process frame is pushed in towards the rear relative to the body casing 2.

Then, the first guide shaft 48 of the process frame 12 is guided to the rear along the first guide groves 54 in the body casing 2, and the engagement portion 35 of the cyan process cartridge 13C comes into abutment with the abutment portion 56 of the body casing 2 such that a leading end of the engagement portion 35 enters into a lower side of a leading end of the abutment portion 56.

Then, when the process frame 12 is pushed in further towards the rear, the shutter 31 is made to swing towards the front against the biasing force of the coil spring due to the engagement portion 35 receiving a reaction from the abutment portion 56. Namely, the shutter 31 starts moving from the closed position towards the open position.

Then, when the process frame 12 continues to be pushed in, due to the engagement portion 35 receiving the reaction from the abutment portion 56, the shutter 31 moves against the biasing force of the coil spring via the half-open position as is shown in FIG. 6 to the intermediate position lying along the length of the portion which extends from the half-open position to the open position as is shown in FIG. 7, eventually entering the interior of the body casing 2.

As this occurs, the sliding and grazing portion 36 of the shutter 31 of the cyan process cartridge 13C comes into abutment with the restricting portion 57 of the body casing 2.

Then, when the process frame 12 continues to be pushed in, due to the sliding and grazing portion 36 being brought into sliding and grazing contact with the restricting portion 57, the shutter 31 of the cyan process cartridge 13C is allowed to move deep into the body casing 2 with its posture so maintained.

Then, as shown in FIG. 8, as with the cyan process cartridge 13C, the magenta process cartridge 13M, the yellow process cartridge 13Y and the black process cartridge 13K are also allowed to enter the interior of the body casing 2 sequentially in that order with their shutters 31 postured as having been caused to move from the closed position to the intermediate position.

As this occurs, the first guide shaft 48 of the process frame 12 has been guided just before the bent portions 63 of the first guide grooves 54 in the body casing 2, and the second guide shaft 49 of the process frame 12 start to fit in the second guide grooves 55 in the body casing 2.

In addition, the sliding and grazing portions 36 of all the shutters 31 are in sliding and grazing contact with the restricting portion 57 of the body casing 2.

Then, when the process frame 12 continues to be pushed in, the first guide shaft 48 and the second guide shaft 49 are made to move further rearwards while descending along the bent portions 63 in the first guide grooves 54 and the bent portions 64 in the second guide grooves 55, respectively, whereby the process frame 12 is allowed to move further rearwards while descending.

Then, due to the sliding and grazing portions 36 each receiving a reaction from the restricting portion 57, the individual shutters 31 are made to swing upwards to move from the intermediate position towards the open position.

Then, when the reference shaft 52 of the body casing 2 fits in the reference groove 50 on the process frame 12, the process frame 12 is positioned in the body casing 2, whereby the installation of the process frame 12 into the body casing 2 is completed. In addition, at the same time as this occurs, the individual shutters 31 are disposed in the open positions. Additionally, both the lower end portions in the left-right direction of the process frame 12 are supported by the frame support portions 53.

5. Functions and Advantages (1) According to this color laser printer 1, the process cartridges 13 which have the photosensitive drums 16 are installed in the drawable process frame 12. In addition, by the process frame 12 being operated to be installed in the body casing 2, the shutters 31 provided on the process cartridges 13 are caused to move from the closed position where the photosensitive drums 16 are covered to the open position where the photosensitive drums 16 are exposed.

Because of this, in the stage in which the process cartridges 13 are installed in the process frame 12 which has been drawn out of the body casing 2, the shutters 31 are located in the closed position where they cover the corresponding photosensitive drums 16. Then, it is not until the process frame 12 is operated to be installed into the body casing 2 that the shutters 31 are caused to move from the closed position where they cover the photosensitive drums 16 to the open position where they expose the photosensitive drums 16.

As a result, the photosensitive drums 16 can be kept protected until the process frame 12 is installed into the body casing 2.

(2) In addition, according to the color laser printer 1, the body casing 2 includes the abutment portion 56 adapted to be brought into abutment with the engagement portions 35 of the shutters 31 at the most upstream side of the installing direction of the process frame 12, that is, at the upper portion of the front end portion of the shutter opening plate 65. In addition, by the engagement portions 35 being brought into abutment with the abutment portion 56, the shutters 31 are caused to move from the closed position towards the open position.

Because of this, when the process frame 12 is installed into the body casing 2, the shutters 31 can be brought into abutment with the abutment portion 56 immediately before the shutters 31 enter the interior of the body casing 2, so as to be caused to move from the closed position to the open position in an ensured fashion.

In addition, according to this configuration, a space for allowing the shutters 31 to move from the closed position to the open position is not required to be provided in the interior of the body casing 2, whereby making compact the color laser printer 1 can be realized.

(3) Additionally, according to the color laser printer 1, the postures of the shutters 31 are maintained by the restricting portion 57 after they have been caused to move by the abutment portion 56.

Because of this, when the process frame 12 is installed into the body casing 2, even after the shutters 31 have entered the interior of the body casing 2, the postures of the shutters 31 which have been caused to move from the closed position to the open position can be maintained. By this configuration, the process frame 12 can continue to be operated to be installed into the body casing 2 with the shutters 31 kept moving from the closed position towards the open position.

As a result, in the interior of the body casing 2, the postures of the shutters 31 which have been caused to move from the closed position to the open position can be maintained in an ensured fashion.

(4) In addition, according to the color laser printer 1, the shutters 31 enter the interior of the body casing 2 in such a state that the shutters 31 have moved to the intermediate position which lies along the length of the portion which extends from the half-open position to the open position.

Because of this, the shutters 31 can be made to enter the interior of the body casing 2 using the portion which extends from the half-portion to the open position as a play. By this configuration, even though the shutters 31 are brought into interference with other members of the body casing 2, since the interference can be absorbed by the play, the shutters 31 can be prevented from being damaged by the interference.

Further, since the intermediate position lies somewhere from the half-open position to the open position, in the body casing 2, a space for allowing the shutters 31 to move from the intermediate position to the open position can be made small.

As a result, the shutters 31 can be prevented from being damaged while making compact the color laser printer 1.

(5) According to the color laser printer 1, the shutters 31 are made to be disposed in the open position when the process frame 12 has completely been installed into the body casing 2.

Because of this, when the process frame 12 has been completely installed into the body casing 2, the photosensitive drums 16 is allowed to be exposed in an ensured fashion.

(6) In addition, according to the color laser printer 1, the open position is situated further upstream in the installing direction of the process frame 12, that is, further forwards than the closed position. Because of this, by making use of the operation of installing the process frame 12 into the body casing 2, the shutters 31 can be caused to move from the closed position towards the open position.

As a result, the movement of the shutters 31 from the closed position to the open position can be interlocked with the installing operation of the process frame 12 into the body casing 2.

(7) In addition, according to the color laser printer 1, with respect to the installing direction of the process frame 12, the open position is situated on the same side as the developing unit 15 which lies adjacent to the photosensitive drum 15 relative to the photosensitive drum 16.

Because of this, the shutters 31 can be made to retreat into developing unit side spaces in the corresponding process cartridges 13, this obviating the necessity of providing separately spaces into which the shutters 31 retreat when the shutters 31 are in the open positions.

As a result, the color laser printer Is can be made compact in size.

(8) In addition, according to the color laser printer 1, the shutter 31 is supported on the process cartridge 13 at one end thereof via the swing shaft 34 and is made to swing on the swing shaft 34 as the fulcrum to thereby be able to move between the closed position and the open position.

Because of this, the shutter 31 can be configured by the simple configuration in which the shutter 31 is supported by the swing shaft 34 in such a manner as to swing freely thereon.

(9) In addition, according to the color laser printer 1, the restricting portion 57 is disposed on the left-hand side of the transport belt 24 and closer to the side of the transport belt 24 than the upper end face of the transport belt 24.

Because of this, in installation of the process cartridges 13, the space between the photosensitive drums 16 and the transport belt 24 can be narrowed, thereby making it possible to make the color laser printer 1 compact in size.

Moreover, the restricting portion 57 is formed in such a manner as to extend along the installing direction of the process frame 12, that is, along the front-rear direction.

Because of this, the postures of the shutters 31 can be maintained in an ensured fashion throughout the installing operation of the process cartridges 13.

As a result, the movement of the shutters 31 from the closed position to the open position can be interlocked with the installing operation of the process frame 12 into the body casing 2, while enabling the color laser printer 1 to be formed compact in size.

(10) In addition, according to the process cartridge 31, the shutter 31 confronts the corresponding developing unit 15 in the open position.

Because of this, the shutter member 31 can be made to retreat into a space which confronts the developing unit 15, thereby making it possible to obviate the necessity of providing separately a space into which the shutter 31 is allowed to retreat when the shutter 31 is in the open position.

As a result, the process cartridge 13 can be made compact in size.

As described above, according to the first aspect of the invention, the process cartridges which have the photosensitive members are installed in the drawable process frame. In addition, by the process frame being operated to be installed in the image forming apparatus main body, the shutter members provided on the process cartridges are caused to move from the closed position where the photosensitive members are covered to the open position where the photosensitive members are exposed.

Because of this, in the stage in which the process cartridges are installed in the process frame which has been drawn out of the image forming apparatus main body, the shutter members are located in the closed position where they cover the corresponding photosensitive members. Then, it is not until the process frame is operated to be installed into the image forming apparatus main body that the shutter members are caused to move from the closed position where they cover the photosensitive members to the open position where they expose the photosensitive members.

As a result, the photosensitive members can be kept protected until the process frame is installed into the image forming apparatus main body.

In addition, according to the second aspect of the invention, the image forming apparatus main body includes the abutment portion adapted to be brought into abutment with the shutter members at the most upstream side of the installing direction of the process frame. In addition, by being brought into abutment with the abutment portion, the shutter members are caused to move from the closed position towards the open position.

Because of this, when the process frame is installed into the image forming apparatus main body, the shutter members can be brought into abutment with the abutment portion immediately before the shutter members enter the interior of the image forming apparatus main body, so as to be caused to move from the closed position to the open position in an ensured fashion.

In addition, according to this configuration, a space for allowing the shutter members to move from the closed position to the open position is not required to be provided in the interior of the image forming apparatus main body, whereby making compact the image forming apparatus can be realized.

Additionally, according to the third aspect of the invention, the postures of the shutter members are maintained by the restricting portion after they have been caused to move by the abutment portion.

Because of this, when the process frame is installed into the image forming apparatus main body, even after the shutter members have entered the interior of the image forming apparatus main body, the postures of the shutter members which have been caused to move from the closed position to the open position can be maintained. By this configuration, the process frame can continue to be operated to be installed into the image forming apparatus with the shutter members kept moving from the closed position towards the open position.

As a result, in the interior of the image forming apparatus main body, the postures of the shutter members which have been caused to move from the closed position to the open position can be maintained in an ensured fashion.

In addition, according to the fourth aspect of the invention, the shutter members enter the interior of the image forming apparatus main body in such a state that the shutter members have moved to the intermediate position lying along the length of the portion which extends from the half-open position to the open position.

Because of this, the shutter members can be made to enter the interior of the image forming apparatus main body using the portion which extends from the half-portion to the open position as a play. By this configuration, even though the shutter members are brought into interference with other members of the image forming apparatus main body, since the interference can be absorbed by the play, the shutter members can be prevented from being damaged by the interference.

Further, since the intermediate position lies somewhere from the half-open position to the open position, in the image forming apparatus main body, a space for allowing the shutter members to move from the intermediate position to the open position can be made small.

As a result, the shutter members can be prevented from being damaged while making compact the image forming apparatus.

According to the fifth aspect of the invention, the shutter members are made to be disposed in the open position when the process frame has completely been installed into the image forming apparatus main body.

Because of this, when the process frame has been completely installed into the image forming apparatus main body, the photosensitive members can be exposed in an ensured fashion.

In addition, according to the sixth aspect of the invention, the open position is situated further upstream in the installing direction of the process frame than the closed position. Because of this, by making use of the operation of installing the process frame into the image forming apparatus main body, the shutter members can be caused to move from the closed position towards the open position.

As a result, the movement of the shutter members from the closed position to the open position can be interlocked with the installing operation of the process frame into the image forming apparatus main body.

In addition, according to the seventh aspect of the invention, with respect to the installing direction of the process frame, the open position is situated on the same side as the developing unit which lies adjacent to the photosensitive member relative to the photosensitive member.

Because of this, the shutter members can be made to retreat into developing unit side spaces in the corresponding process cartridges, this obviating the necessity of providing separately spaces into which the shutter members retreat when they are in the open positions.

As a result, the image forming apparatus can be made compact in size.

In addition, according to the eighth aspect of the invention, the shutter member is supported on the process cartridge at one end thereof via the swing shaft and is made to swing on the swing shaft as the fulcrum to thereby move between the closed position and the open position.

Because of this, the shutter member can be configured by the simple configuration in which the shutter member is supported by the swing shaft in such a manner as to swing freely thereon.

In addition, according to the ninth aspect of the invention, the restricting portion is disposed outwards of the endless belt in the left-right direction and closer to the endless belt side than the contact plane between the endless belt and the photosensitive members.

Because of this, in installation of the process cartridges, the space between the photosensitive members and the endless belt can be narrowed, thereby making it possible to make the image forming apparatus compact in size.

Moreover, the restricting portion is formed in such a manner as to extend along the installing direction of the process frame.

Because of this, the postures of the shutter members can be maintained in an ensured fashion throughout the installing operation of the process cartridges.

As a result, the movement of the shutter members from the closed position to the open position can be interlocked with the installing operation of the process frame into the image forming apparatus main body, while enabling the image forming apparatus to be formed compact in size.

According to the tenth aspect of the invention, the shutter member confronts the developing unit in the open position.

Because of this, the shutter member can be made to retreat into a space which confronts the developing unit, thereby making it possible to obviate the necessity of providing separately a space into which the shutter member is allowed to retreat when the shutter member is in the open position.

As a result, the process cartridge can be made compact in size.

What is claimed is:

1. An image forming apparatus comprising:

a main body;

a process frame configured to be removably installed into the main body; and a process cartridge configured to be detachably installed in the process frame, the process cartridge including:

a photosensitive member; and a shutter member that is configured to be movable between a closed position where the photosensitive member is covered and an open position where the photosensitive member is exposed, wherein the shutter member moves from the closed position to the open position as the process frame is installed into the main body.

2. The image forming apparatus according to claim 1, wherein the main body comprises an abutment portion that is configured to be in abutment with the shutter member at a most upstream side of an installing direction of the process frame, the abutment portion being configured to move the shutter member from the closed position toward the open position.

3. The image forming apparatus according to claim 2, wherein the main body comprises a restricting portion that is configured to be in sliding contact with the shutter member after the shutter member is moved by the abutment portion, the restricting portion being configured to keep a posture of the shutter member that is moved by the abutment portion.

4. The image forming apparatus according to claim 2, wherein the abutment portion is configured to move the shutter member to an intermediate position that is positioned between a half-open position and the open position, the half-open position being positioned in a middle position between the closed position and the open position.

5. The image forming apparatus according to claim 4, wherein the shutter member is positioned at the open position when the process cartridge is fully installed in the main body.

6. The image forming apparatus according to claim 1, wherein a position of the shutter member when the shutter member is positioned at the open position is disposed upstream of a position when the shutter member is positioned at the closed position in the installing direction of the process frame.

7. The image forming apparatus according to claim 1, wherein the process cartridge comprises a developing unit which is disposed adjacent to the photosensitive member and which is disposed upstream of the photosensitive member in the installing direction.

8. The image forming apparatus according to claim 1, wherein an axial portion is provided in one end of the shutter member, the shutter member is supported on the process cartridge through the axial portion of the shutter member, and the shutter member is configured to swing around the axial portion such that the shutter member moves between the closed position and the open position.

9. The image forming apparatus according to claim 3, further comprising:

an endless belt that is in contact with the photosensitive member, and wherein the restricting portion is disposed outside of the endless belt in a direction perpendicular to a moving direction of the endless belt, the restricting portion is disposed closer to an endless belt side than a contact surface between the endless belt and the photosensitive member, and the restricting portion is configured to extend along the installing direction of the process frame.

10. An image forming apparatus comprising:

a main body;

a process frame configured to be moved between a first position that is disposed inside of the main body and a second position in which the process frame is drawn from the main body, a process cartridge configured to be detachably installed in the process frame, the process cartridge including:

a photosensitive member; and a shutter member that is configured to move between a closed position where the photosensitive member is covered and an open position where the photosensitive member is exposed, wherein the shutter member is configured to move from the closed position to the open position while the process frame moves from the second position to the first position.

11. The image forming apparatus according to claim 10, wherein the main body comprises an abutment portion that is configured to be in abutment with the shutter member at a most upstream side of an installing direction of the process frame, the abutment portion being configured to move the shutter member from the closed position toward the open position.

12. The image forming apparatus according to claim 11, wherein the main body comprises a restricting portion that is configured to be in sliding contact with the shutter member after the shutter member is moved by the abutment portion, the restricting portion being configured to keep a posture of the shutter member that is moved by the abutment portion.

13. The image forming apparatus according to claim 11, wherein the abutment portion is configured to move the shutter member to an intermediate position that is positioned between a half-open position and the open position, the half-open position being positioned in a middle position between the closed position and the open position.

14. The image forming apparatus according to claim 13, wherein the shutter member is positioned at the open position when the process cartridge is fully installed in the main body.

15. The image forming apparatus according to claim 10, wherein a position of the shutter member when the shutter member is positioned at the open position is disposed upstream of a position when the shutter member is positioned at the closed position in the installing direction of the process frame.

16. The image forming apparatus according to claim 10, wherein the process cartridge comprises a developing unit which is disposed adjacent to the photosensitive member and which is disposed upstream of the photosensitive member in the installing direction.

17. The image forming apparatus according to claim 10, wherein an axial portion is provided in one end of the shutter member, the shutter member is supported on the process cartridge through the axial portion of the shutter member, and the shutter member is configured to swing around the axial portion such that the shutter member moves between the closed position and the open position.

18. The image forming apparatus according to claim 12, further comprising:

an endless belt that is in contact with the photosensitive member, and wherein the restricting portion is disposed outside of the endless belt in a direction perpendicular to a moving direction of the endless belt, the restricting portion is disposed closer to an endless belt side than a contact surface between the endless belt and the photosensitive member, and the restricting portion is configured to extend along the installing direction of the process frame.

19. An image forming apparatus comprising:

a main body;

a process frame configured to move between a first position that is disposed inside the main body and a second position in which the process frame is drawn from the main body, a process cartridge configured to be detachably installed in the process frame, the process cartridge including:

a photosensitive member; and a shutter member that is configured to move between a closed position where the photosensitive member is covered and an open position where the photosensitive member is exposed, wherein the shutter member is positioned in the closed position when the process frame is positioned in the second position, the shutter member is positioned in the open position when the process frame is positioned in the first position.

20. The image forming apparatus according to claim 19, wherein the main body comprises an abutment portion that is configured to be in abutment with the shutter member at a most upstream side of an installing direction of the process frame, the abutment portion being configured to move the shutter member from the closed position toward the open position.

21. The image forming apparatus according to claim 20, wherein the main body comprises a restricting portion that is configured to be in sliding contact with the shutter member after the shutter member is moved by the abutment portion, the restricting portion being configured to keep a posture of the shutter member that is moved by the abutment portion.

22. The image forming apparatus according to claim 20, wherein the abutment portion is configured to move the shutter member to an intermediate position that is positioned between a half-open position and the open position, the half-open position being positioned in a middle position between the closed position and the open position.

23. The image forming apparatus according to claim 22, wherein the shutter member is positioned at the open position when the process cartridge is fully installed in the main body.

24. The image forming apparatus according to claim 19, wherein a position of the shutter member when the shutter member is positioned at the open position is disposed upstream of a position when the shutter member is positioned at the closed position in the installing direction of the process frame.

25. The image forming apparatus according to claim 19, wherein the process cartridge comprises a developing unit which is disposed adjacent to the photosensitive member and which is disposed upstream of the photosensitive member in the installing direction.

26. The image forming apparatus according to claim 19, wherein an axial portion is provided in one end of the shutter member, the shutter member is supported on the process cartridge through the axial portion of the shutter member, and the shutter member is configured to swing around the axial portion such that the shutter member moves between the closed position and the open position.

27. The image forming apparatus according to claim 21, further comprising:

an endless belt that is in contact with the photosensitive member, and wherein the restricting portion is disposed outside of the endless belt in a direction perpendicular to a moving direction of the endless belt, the restricting portion is disposed closer to an endless belt side than a contact surface between the endless belt and the photosensitive member, and the restricting portion is configured to extend along the installing direction of the process frame.

* * * * *